US011401644B2

(12) United States Patent
Kim et al.

(10) Patent No.: US 11,401,644 B2
(45) Date of Patent: Aug. 2, 2022

(54) METHOD OF CONTROLLING A LAUNDRY TREATING DEVICE

(71) Applicant: LG Electronics Inc., Seoul (KR)

(72) Inventors: Youngmin Kim, Seoul (KR); Sangwoo Lee, Seoul (KR); Jooyeon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 47 days.

(21) Appl. No.: 16/549,085

(22) Filed: Aug. 23, 2019

(65) Prior Publication Data

US 2020/0063313 A1 Feb. 27, 2020

(30) Foreign Application Priority Data

Aug. 23, 2018 (KR) ..... 10-2018-0098815

(51) Int. Cl.
*D06F 39/08* (2006.01)
*D06F 33/36* (2020.01)
(Continued)

(52) U.S. Cl.
CPC ..... *D06F 33/36* (2020.02); *D06F 33/44* (2020.02); *D06F 39/083* (2013.01);
(Continued)

(58) Field of Classification Search
CPC ..... D06F 33/00; D06F 34/18; D06F 39/045; D06F 39/085; D06F 39/087;
(Continued)

(56) References Cited

U.S. PATENT DOCUMENTS

2010/0275657 A1 11/2010 Park et al.
2015/0121631 A1 5/2015 Kang

FOREIGN PATENT DOCUMENTS

AU 2010283165 A1 * 12/2011 ..... D06F 35/005
CN 101173451 A 5/2008
(Continued)

OTHER PUBLICATIONS

European Search Report from the European Patent Office in European Application No. 19192271.5, dated Jan. 8, 2020 (8 pages).
(Continued)

*Primary Examiner* — Michael E Barr
*Assistant Examiner* — Pallavi Chitta
(74) *Attorney, Agent, or Firm* — Birch, Stewart, Kolasch & Birch, LLP

(57) ABSTRACT

The present disclosure relates to a method of controlling a laundry treating device comprising a tub configured to store wash water therein, a drum rotatably disposed within the tub to receive laundry therein, a heater configured to heat the wash water supplied to the tub, a circulating pump configured to circulate the wash water supplied to the tub, and a controller configured to control the tub, the drum, the heater, and the circulating pump. The method comprises detecting an amount of laundry received in the drum, supplying the wash water to the tub based on the amount of laundry, and soaking the laundry by operating the circulating pump. The step of soaking the laundry is selectively progressed based on the amount of laundry detected.

5 Claims, 4 Drawing Sheets

(51) Int. Cl.

| | |
|---|---|
| ***D06F 33/44*** | (2020.01) |
| *D06F 103/04* | (2020.01) |
| *D06F 103/46* | (2020.01) |
| *D06F 105/06* | (2020.01) |
| *D06F 105/28* | (2020.01) |
| *D06F 105/46* | (2020.01) |
| *D06F 105/58* | (2020.01) |

(52) U.S. Cl.
CPC ..... *D06F 2103/04* (2020.02); *D06F 2103/46* (2020.02); *D06F 2105/06* (2020.02); *D06F 2105/28* (2020.02); *D06F 2105/46* (2020.02); *D06F 2105/58* (2020.02)

(58) Field of Classification Search
CPC ..... D06F 2204/086; D06F 2202/10; D06F 2204/04; D06F 2204/082; D06F 2105/46; D06F 2103/46; D06F 2105/28; D06F 2103/04; D06F 2105/06; D06F 33/44
See application file for complete search history.

(56) References Cited

FOREIGN PATENT DOCUMENTS

| | | | | | |
|---|---|---|---|---|---|
| CN | 101177861 | A | * | 5/2008 | |
| CN | 101184884 | A | | 5/2008 | |
| CN | 101255641 | A | | 9/2008 | |
| CN | 101988253 | A | | 3/2011 | |
| CN | 102471972 | A | | 5/2012 | |
| CN | 102677421 | A | | 9/2012 | |
| EP | 1889959 | A1 | * | 2/2008 | ..... D06F 33/34 |
| EP | 1961854 | A1 | * | 8/2008 | ..... D06F 33/00 |
| EP | 2 698 462 | A2 | | 2/2014 | |
| EP | 1 889 959 | B1 | | 10/2016 | |
| JP | 2008113982 | A | * | 5/2008 | |
| JP | 2013-052053 | A | | 3/2013 | |
| JP | 2014-057769 | A | | 4/2014 | |
| KR | 10-2004-0001389 | | | 1/2004 | |
| KR | 10-2005-0012526 | | | 2/2005 | |
| KR | 10-2011-0100768 | | | 9/2011 | |
| KR | 101222569 | B1 | * | 1/2013 | |
| KR | 10-2016-0061207 | | | 5/2016 | |
| KR | 10-2018-0028718 | | | 3/2018 | |

OTHER PUBLICATIONS

International Search Report received from the Korean Intellectual Property Office (KIPO) in PCT Application No. PCT/KR2019/010445, dated Dec. 10, 2019 (10 pages).

Chinese Office Action in Chinese Patent Application No. 201910777325.3, dated May 8, 2021 (11 pages).

* cited by examiner

METHOD OF CONTROLLING A LAUNDRY TREATING DEVICE

CROSS-REFERENCE TO RELATED APPLICATIONS

This application claims the benefit of priority under 35 U.S.C. § 119(a) to Korean Patent Application No. 10-2018-0098815, filed on Aug. 23, 2018, the disclosure of which is hereby incorporated by reference in its entirety.

BACKGROUND

Technical Field

The present disclosure relates to a method of controlling a laundry treating device. The present disclosure may, among other things, be suitable for reducing a wash time by improving a wash water heating process according to an amount of laundry.

Discussion of the Related Art

Generally, a laundry treating device refers to a device capable of cleaning laundry through cycles such as washing, rinsing, dewatering and the like to detach contamination or dirt attached to clothes, bedding and the like (hereinafter named 'laundry') received in a drum using wash water and detergent.

A tub receiving wash water therein is disposed within the laundry treating device, a drum receiving laundry therein is rotatably installed in the tub, and a motor generating a drive force of the drum is installed at one side of the tub.

Once laundry is put in such a laundry treating device, the laundry treating device detects an amount of the laundry, determines a supply of wash water and a heating time of the wash water according to the detected laundry amount, and progresses a washing course through washing, rinsing and dewatering cycles.

In doing so, during the step of heating wash water, after an amount of laundry has been detected, wash water is supplied to the laundry to progress a laundry soaking step before washing. In addition, a laundry soaking step is performed to soak contaminants or dirt of the laundry or to prevent protein solids in the contaminants/dirt of the laundry from being stuck to the laundry.

Recently, in performing the laundry soaking step, a laundry treating device configured to perform laundry soaking by directly spraying wash water to laundry in a drum from a front side of the drum has been developed and used.

However, when a laundry treating device performs laundry soaking by directly spraying wash water to laundry, a level of wash water stored in a tube rises slowly due to the wash water soaking into the laundry. If the level of the wash water in the tub increases slowly, an operation of a heater heating the wash water is delayed, thereby causing a problem that an overall wash cycle is late.

SUMMARY

Accordingly, embodiments of the present disclosure are directed to a method of controlling a laundry treating device that substantially obviates one or more problems due to limitations and disadvantages of the related art.

One object of the present disclosure is to provide a method of controlling a laundry treating device capable of reducing a washing cycle time by improving a timing of heating wash water while supplying wash water.

Another object of the present disclosure is to provide a method of controlling a laundry treating device capable of reducing a washing cycle time by skipping a laundry soaking step according to an amount of laundry.

Technical tasks obtainable from the present disclosure are not limited by the above-mentioned technical tasks. In addition, other unmentioned technical tasks can be clearly understood from the following description by those having ordinary skill in the technical field to which the present disclosure pertains.

Additional advantages, objects, and features of the present disclosure will be set forth in the disclosure herein as well as the accompanying drawings. Such aspects may also be appreciated by those skilled in the art based on the disclosure herein.

To achieve these objects and other advantages and in accordance with the purpose of the present disclosure, as embodied and broadly described herein, a method of controlling a laundry treating device comprising a tub configured to store wash water therein, a drum rotatably disposed within the tub to receive laundry therein, a heater configured to heat the wash water supplied to the tub, a circulating pump configured to circulate the wash water supplied to the tub, and a controller configured to control the tub, the drum, the heater, and the circulating pump and progress a washing cycle, a rinsing cycle and a dewatering cycle according to an embodiment of the present disclosure may comprise detecting an amount of laundry received in the drum, supplying the wash water to the tub based on the amount of laundry, and soaking the laundry by operating the circulating pump, wherein the soaking the laundry is selectively progressed based on the amount of laundry detected.

In some embodiments, the soaking the laundry may be progressed by operating the circulating pump when the amount of laundry is equal to or greater than a predetermined laundry amount.

In some embodiments, the method may further comprise heating the wash water by operating the heater when the amount of laundry is equal to or smaller than the predetermined laundry amount.

In some embodiments, the heating the wash water may be executed after standing by for a predetermined time after the supplying the wash water to the tub.

In some embodiments, the predetermined time may be a time taken for the wash water stored in the tub to reach a predetermined water level for the heater to be submerged.

In some embodiments, the method may further comprise operating the circulating pump in a reverse direction when the wash water stored in the tub reaches the predetermined water level such that the wash water in the circulating pump flows back.

In some embodiments, the operating the circulating pump in the reverse direction may be performed during the supplying the wash water to the tub.

In some embodiments, the circulating pump operates in a forward direction to circulate the wash water of the tub.

In some embodiments, the method may further comprise waiting for a predetermined time after completion of the step of soaking the laundry.

In some embodiments, waiting for the predetermined time comprises waiting until a water level of the wash water reaches a predetermined water level for the heater to be submerged.

In some embodiments, the wash water in the circulating pump may flow back when the circulating pump operates in a reverse direction.

Further scope of applicability of the present disclosure will become apparent from the detailed description given hereinafter. However, it should be understood that the detailed description and specific examples, while indicating preferred embodiments of the disclosure, are given by illustration only, since various changes and modifications within the spirit and scope of the disclosure will become apparent to those skilled in the art from this detailed description.

Accordingly, embodiments of the present disclosure provide various effects and/or features.

According to the present disclosure, in a method of controlling a laundry treating device, a wash cycle time can be reduced by improving a timing of heating wash water while supplying the wash water.

According to the present disclosure, a method of controlling a laundry treating device, a wash cycle time can be reduced by skipping a laundry soaking step according to an amount of laundry.

Effects obtainable from the present disclosure may not be limited by the above mentioned effect. And, other unmentioned effects can be clearly understood from the following description by those having ordinary skill in the technical field to which the present disclosure pertains.

BRIEF DESCRIPTION OF THE DRAWINGS

The present disclosure will become more fully understood from the detailed description given herein below and the accompanying drawings, which are given by illustration only, and thus are not limitative of the present disclosure, and wherein.

DETAILED DESCRIPTION

Reference will now be made in detail to a laundry treating apparatus according to an embodiment of the present disclosure, examples of which are illustrated in the accompanying drawings.

Terminologies or words used in this specification and claims are not construed as limited to the general or dictionary meanings and should be construed as the meanings and concepts matching the technical idea of the present disclosure based on the principle that a person having ordinary skill in the art is able to appropriately define the concepts of the terminologies to describe the intention in best way. In addition, the names defined for the respective components may be called other names in the art to which the present disclosure pertains.

Therefore, the following embodiments are merely exemplary and are not to be considered as limiting the present disclosure. It will be appreciated by those skilled in the art that various modifications and variations can be made from the disclosure, and the present disclosure covers the modifications and variations.

First of all, a method of controlling a laundry treating apparatus according to an embodiment of the present disclosure is described in detail with reference to the accompanying drawings. For clarity of the description, wherever possible, the same reference numbers will be used throughout the drawings to refer to the same or similar parts. Moreover, detailed description of the same components of the related art will be omitted but the parts related to the present disclosure shall be described in detail.

Figure 1:
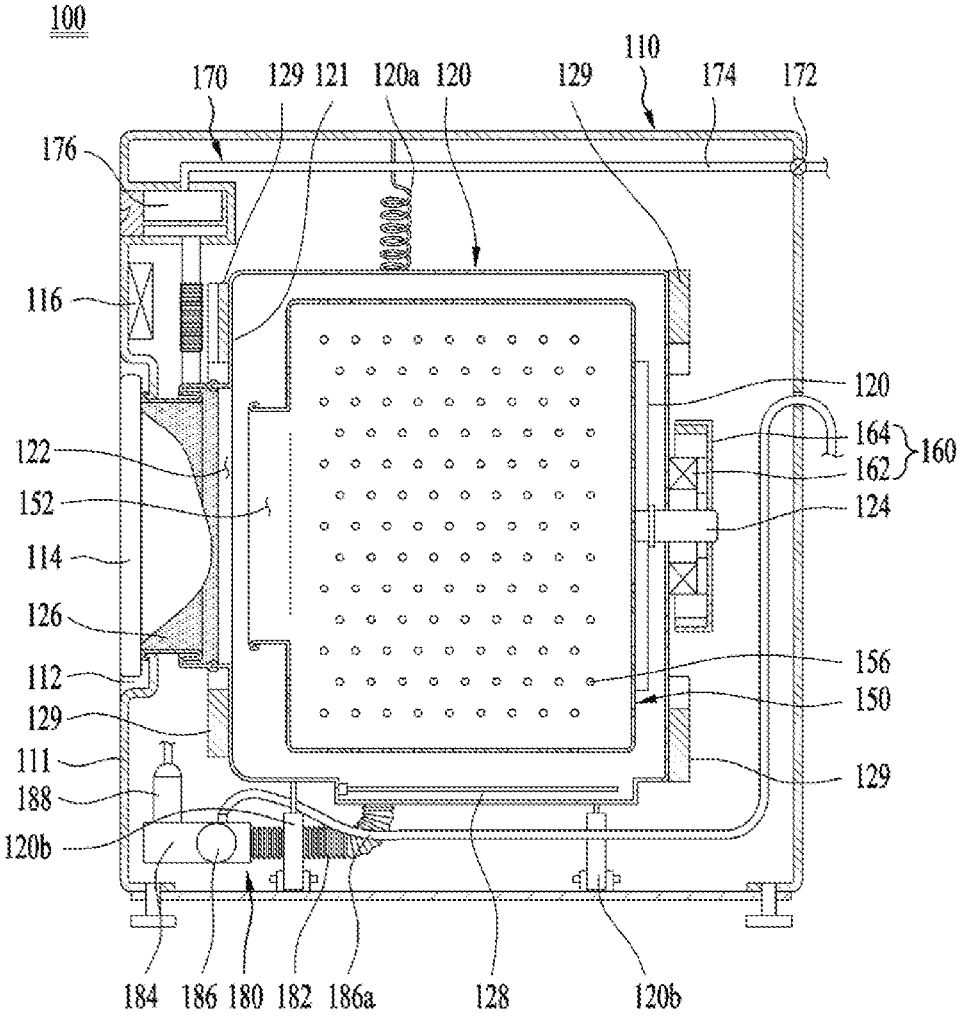
FIG. 1 is a schematic diagram illustrating a laundry treating apparatus according to an embodiment of the present disclosure.
Figure 2:
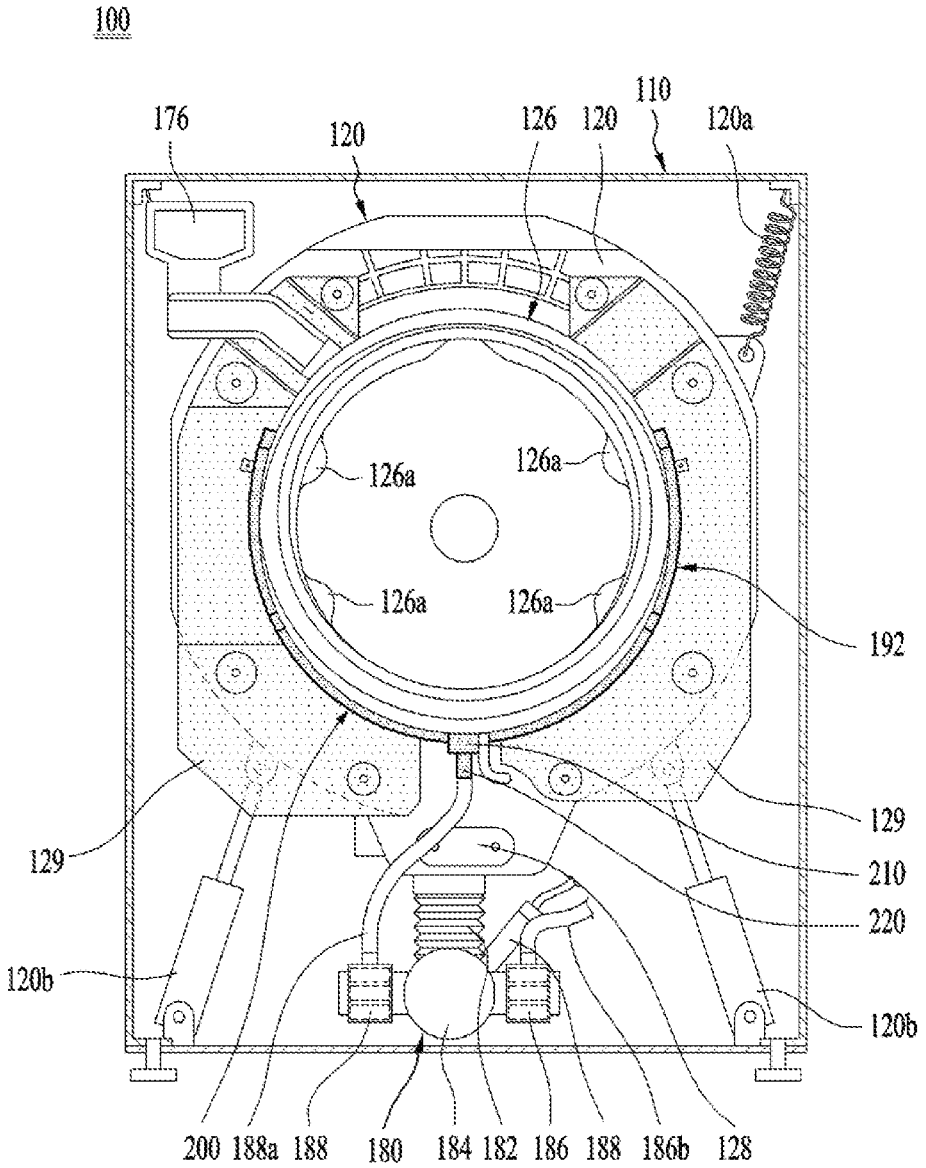
FIG. 2 is a front diagram illustrating a laundry treating apparatus according to an embodiment of the present disclosure.
Figure 3:
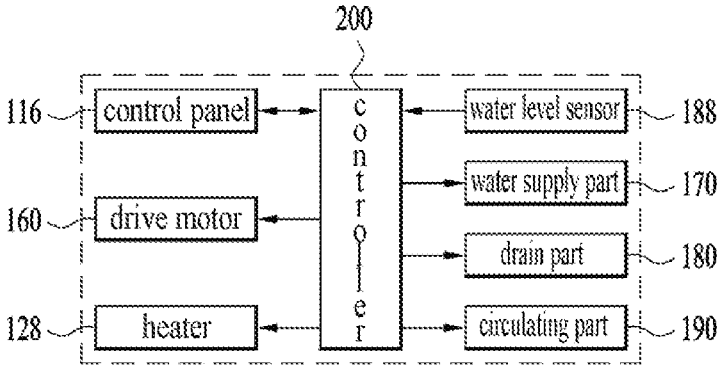
FIG. 3 is a diagram illustrating a configuration of a laundry treating apparatus according to an embodiment of the present disclosure.

FIG. 1 is a schematic diagram showing a laundry treating apparatus according to an embodiment of the present disclosure, and FIG. 2 is a front diagram showing a laundry treating apparatus according to an embodiment of the present disclosure.

Referring to FIG. 1 and FIG. 2, a laundry treating apparatus 100 according to an embodiment of the present disclosure may include a cabinet 110 forming an exterior, a tub 120 flexibly supported inside the cabinet 110 by a suspension so as to store wash water therein, a drum 150 rotatably disposed within the tub 120 so as to progress washing/rinsing/dewatering when laundry is placed therein, a drive motor 160 configured to transfer a rotational force to the drum 150 to rotate, a water supply part 170 configured to supply wash water to the tub 120, a drain part 180 configured to drain wash water supplied to the tub 120 and complete a washing/rinsing cycle and wash water discharged from laundry in a dewatering cycle, a circulating part 190 configured to directly spray wash water to laundry by circulating wash water within the tub in the washing/rinsing cycle, a vibration insulating part 126 provided between the cabinet 110 and the tub 120 to prevent vibration of the tub 120 from being transferred to the cabinet 110, and a controller 200 configured to control a progress of a laundry soaking step and a heating timing of wash water according to an amount of laundry placed in the drum 150.

The cabinet 110 may comprise a front panel 111 forming an exterior of the laundry treating apparatus 100 and having an entrance 112 formed therein to put laundry therethrough, and a door 114 configured to open/close the entrance 112 may be rotatably installed on the front panel 111. In some embodiments, one side of the vibration insulating part 126 may be connected to the entrance 112.

A control panel 116 may be provided to a top end of the front panel 111 of the cabinet 110. The control panel 116 may include a manipulating unit (not shown) provided with a plurality of buttons or knobs to manipulate operations of the laundry treating apparatus 100 and a display unit (not shown) including LED and/or LCD for displaying an operational status of the laundry treating apparatus 100.

The tub 120 may be provided within the cabinet 110 to receive wash water therein, and a spring 120*a* and a damper 120*b* may be provided on the top and bottom sides of the tub 120 to attenuate vibration of the tub 120 and to prevent the vibration of the tub 120 from being transferred to the cabinet 110, respectively.

Meanwhile, a sump 127 for collecting wash water within the tub 120 may be formed on the bottom side of the tub 120, and a heater 120 heating the wash water collected in the sump 127 may be provided to an inside of the sump 127. Here, the drain part 180 may be connected to the bottom of the sump 127.

Moreover, a front face in which a tub opening 122 for putting laundry therethrough is formed may be formed in front of the tub 120, and the other side of the vibration insulating part 126 may be connected to the tub opening 122.

Meanwhile, a balance weight 129 for attenuating the vibration of the tub 120 by increasing the weight of the tub 120 may be provided to each of the front and rear sides of the tub 120. Here, the balance weight 129 may be installed on each of the front and rear sides of the tub 120 in different weight, shape and disposition.

Meanwhile, a rotatable shaft 124 perforating the rear side of the tub 120 may be provided on the rear side of the tub 120 and may be rotatably supported by a bearing housing (not shown), and the rotatable shaft 124 may be connected to a spider 153 of the rear side of the drum 150 located within the tub 120. The rotatable shaft 124 may be connected to a drive motor 160 provided on an outer surface of the rear side of the tub 120.

Here, the drive motor 160 may comprise a stator 162 fixed to the rear side of the tub 120 and a rotor 164 formed on an outer circumference of the stator 162 so as to be connected to the rotatable shaft 124. In case of the drive motor 160, various embodiments may be available and details shall be omitted.

The vibration insulating part 126 of a bellows type may be provided between the tub opening 122 and the entrance 112 of the cabinet 110 to seal a space between the tub 120 and the cabinet 110 and to prevent the vibration of the tub 120 from being transferred to the cabinet 110. A water supply hose 174, a detergent supplier 176, an annular passage part 192 and the like, which will be described later, may be connected to the vibration insulating part 126.

Moreover, a plurality of diffusion nozzles 126*a* may be formed in an inner circumference of the vibration insulating part 126 so as to spray wash water into the drum 150 when connected to the annular passage part 192. Each of the diffusion nozzles 126*a* may be configured to diffusively spray wash water to a different position within the drum 150.

The water supply part 170 may be provided above the tub 120 to supply wash water supplied from an external wash water supply source (not shown) to the tub 120. The water supply part 170 may comprise a water supply valve 172 and a water supply hose 174. Moreover, the water supply part 170 may further comprise a detergent supplier 176 configured to mix detergent, fabric softener, bleach and the like, which may be separately supplied together with the wash water supply of the wash water hose 174, with wash water and supply the mix to the tub 120.

Here, the detergent supplier 176 may be provided on a top end of the front side of the cabinet 110 and may be configured in form of a drawer capable of being pulled out in a front direction. The detergent supplier 176 may be provided on one side of the front control panel 116 of the cabinet 110.

The drain part 180 may be connected to the sump 127 at the bottom side of the tub 120 so as to externally discharge the wash water after completing washing and rinsing and the wash water generated from dewatering.

Here, the drain part 180 may comprise a drain pipe 182 connected to a bottom of the tub 120 so as to collect and drain wash water within the tub 120, a drain chamber 184 in which wash water drained through the drain pipe 182 may be temporarily held, a drain pump 186 connected to one side of the drain chamber 184 to drain wash water, and a drain hose 186*a* connected to the drain pump 186 to discharge wash water out of the laundry treating apparatus 100.

In some embodiments, the drain chamber 184 may be provided with a water level sensor 188 configured to sense a water level of wash water held in the tub 120 by sensing a pressure changed by wash water supplied to the tub 120.

The circulating part 190 may circulate wash water within the tub 120 by supplying some of wash water flowing into the drain chamber 184 to the annular passage part 192. The circulating part 190 may comprise a circulating pump 194 connected to the other side of the drain chamber 184 so as to circulate wash water of the drain chamber 184, a circulating hose 194*a* guiding wash water moved by the circulating pump 194 to the annular passage part 192, and the annular passage part 192 connected to the circulating hose 194*a* so as to spray wash water supplied through the circulating hose 194*a* into the drum 150.

Meanwhile, the circulating pump 194 may be provided to enable a flow rate (or discharged water pressure) to vary. To this end, a motor configured to drive the circulating pump 194 may include a variable speed motor capable of controlling a rotation speed.

In some embodiments, the motor driving the circulating pump 194 may comprise a Brushless Direct Current (BLDC) motor and may further comprise an inverter driver for controlling the speed of the motor. The inverter driver may convert AC power into DC power and then input the DC power to the motor at a target frequency, thereby controlling the rotation speed of the motor. Therefore, by controlling the rotation speed of the motor, the flow rate of wash water supplied to the circulating hose 194*a* from the circulating pump 194 can be controlled uniformly.

Moreover, the circulating pump 194 may have a passage of a volute type for supplying wash water to the circulating hose 194*a* and may circularly supply wash water, which may flow into the drain chamber 184 according to the forward rotation of the circulating pump 194, to the circulating hose 194*a*.

Meanwhile, the motor configured to drive the circulating pump 194 can control a rotation direction as well as a rotation speed. Particularly, an induction motor applied to the related art pump may be unable to control the rotation direction on operation. Yet, because the motor of the present disclosure can control the rotation direction on operation, it may be able to control the supply of the wash water supplied to the circulating hose 194*a*. Namely, as the wash water remaining in the circulating hose 194*a* is made to flow into the drain chamber 184 according to the reverse rotation of the circulating pump 194, water levels of the drain chamber 184 and the sump 127 connected to the drain chamber 184 can be raised temporarily.

Here, the annular passage part 192 may extend along an outer circumference of the vibration insulating part 126 and may then be connected to a plurality of the diffusion nozzles 126*a* formed in the vibration insulating part 126, thereby guiding the wash water to the diffusion nozzles 126*a*. Thus, the wash water guided to the diffusion nozzles 126*a* by the annular passage part 192 may be diffusively sprayed into the drum 150 by the diffusion nozzles 126*a*, thereby soaking laundry.

The controller 200 may be configured to control the respective operational configurations of the laundry treating apparatus 100 by being linked to the control panel 116 provided to the cabinet 110. The controller 200 may control a supply amount of wash water supplied from the water supply part 170 according to an amount of laundry put into the drum 150, a rotation speed and operational time of the drive motor 160, a wash time according to the water supply amount, a circulation timing and time of wash water by the circulating part 190, etc.

As such, a control process by the controller may be progressed variously according to an operation of a laundry treating apparatus. General control processes may be omitted but processes relevant to the present disclosure are described in detail.

An operation of a laundry treating apparatus according to an embodiment of the present disclosure is described in detail through an embodiment. The respective elements mentioned in the following should be understood with reference to the aforementioned description and drawings.

Figure 4:
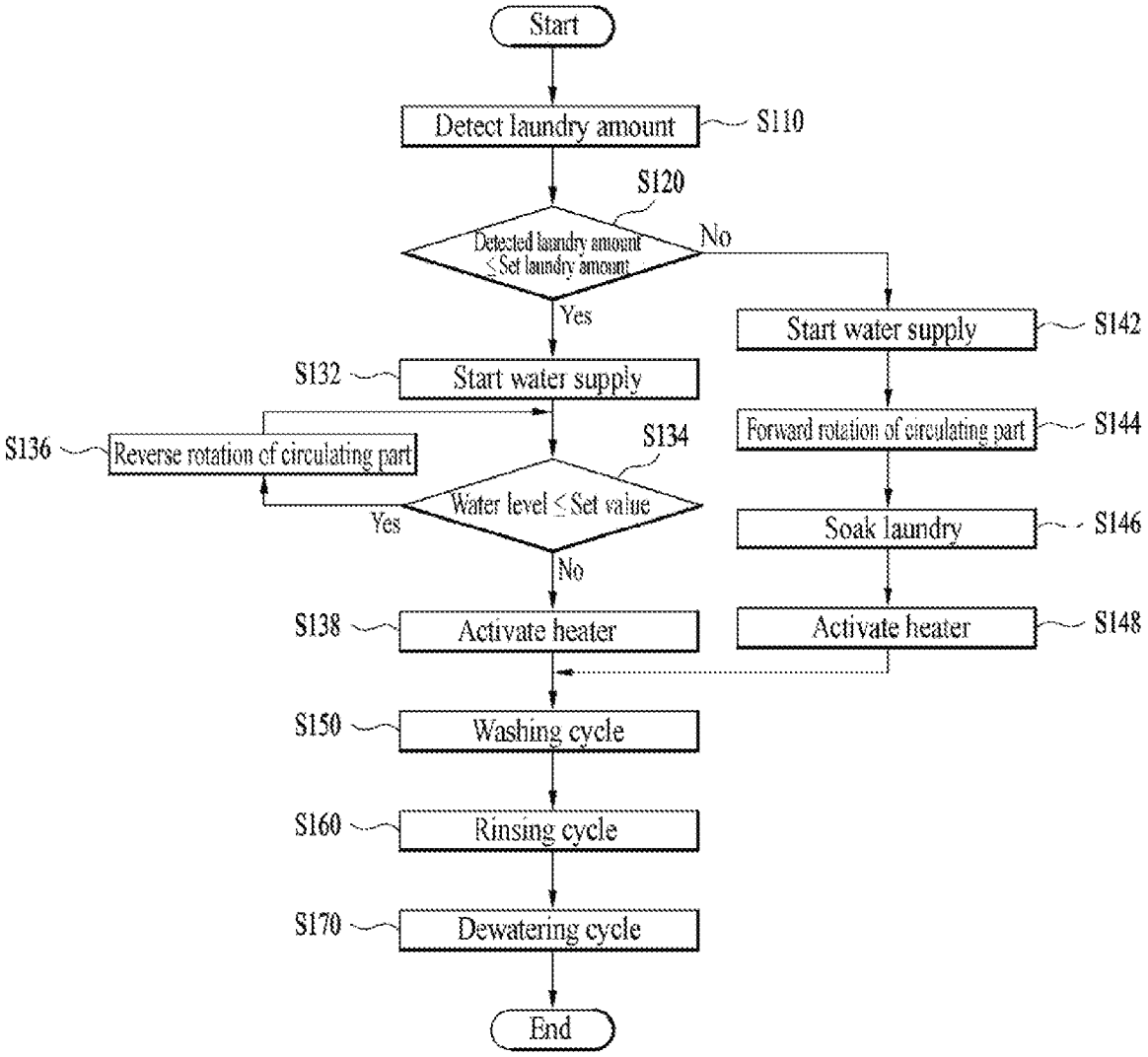
FIG. 4 is a flowchart illustrating a process for controlling a laundry treating apparatus according to an embodiment of the present disclosure.

FIG. 4 is a flowchart illustrating a process for controlling a laundry treating apparatus according to an embodiment of the present disclosure.

A user may set the operational conditions of the laundry treating apparatus 100 by controlling the control panel 116 of the laundry treating apparatus 100. Accordingly, the controller 200 may detect a laundry amount of laundry put into the laundry treating apparatus 100 according to user's settings and set an amount of wash water, a washing time, a rinsing time/count, a dewatering time and the like according to the detected laundry amount, thereby performing operations of a washing cycle S150, a rinsing cycle S160, and a dewatering cycle S170.

Here, the present disclosure may relate to a control method of selectively executing a laundry soaking S146 of the laundry according to water supply of wash water before the washing cycle S150 in response to the laundry amount detection S110 and changing a condition for a heater activation S138/S148 for heating the wash water according to the selective progress of the laundry soaking S146.

Therefore, the laundry soaking S146 and the condition for the heater activation S138/S148 for the wash water heating shall be described in detail, but the washing cycle S150, the rinsing cycle S160 and the dewatering cycle S170 related to the general operation of the laundry treating apparatus will be omitted. Besides, a drying cycle (not shown) by a separate hot air supplier (not shown) may be progressed additionally after the washing cycle S150, the rinsing cycle S160 and the dewatering cycle S170 that are the general operations of the laundry treating apparatus 100.

Meanwhile, as the operation of the laundry treating apparatus 100 starts, the controller 200 of the laundry treating apparatus 100 may execute the laundry amount detection step S110 of measuring an amount of laundry. In the laundry amount detection step S110, as the drive motor 160 is rotated by the controller 200, the drum 150 having the laundry therein may be rotated. As a load of the drum 150 is changed according to the amount of the laundry loaded in the drum 150, a current value of the drive motor 160 may be varied.

Alternatively, the controller 200 may calculate a laundry amount by rotating the drum 150 at a predetermined rotation speed for a predetermined time through the drive motor 160 and then measuring a time it takes for the rotation speed of the drum 150 to decelerate. Alternatively, the controller 200 may calculate a laundry amount by measuring a time of accelerating the drum 150 while increasing a rotation speed of the drum 150 up to a predetermined rotation speed via the drive motor 160.

Here, regarding the laundry amount detection step S110, the above description is made by taking an example of using a current value according to the rotation of the drive motor 160 and the rotation speed of the drum 150. In some embodiments, such a laundry amount may be detected by various methods.

Meanwhile, the controller 200 may determine whether the laundry soaking S146 is progressed before the washing cycle S150 of the laundry according to the laundry amount detected in the laundry amount detection step S110 [S120]. Namely, if the detected laundry amount is equal to or smaller than a set laundry amount, the controller 200 may progress the washing cycle S150 by skipping the laundry soaking step S146. If the detected laundry amount is greater than the set laundry amount, the controller 200 may progress the washing cycle S150 including the laundry soaking step S146. Here, the set laundry amount may be set to an amount equal to or smaller than a half of a maximum loaded laundry amount of the laundry treating apparatus. For example, if the laundry amount calculated in the laundry amount detection step S110 is equal to or smaller than a half of the maximum loaded laundry amount, the controller 200 may progress the washing cycle by skipping the laundry soaking. If the laundry amount calculated in the laundry amount detection step S110 is greater than a half of the maximum loaded laundry amount, the controller 200 may progress the washing cycle by including the laundry soaking.

In some embodiments, if a laundry amount detected by the aforementioned laundry amount detection is equal to or greater than a set laundry amount, a detergent amount, a wash water amount, a rinsing count, a wash time and the like, which correspond to the laundry amount calculated in the laundry amount detection step S110, may be determined. And, the determined amounts of the wash water and the detergent may be supplied at step S142.

Here, as the wash water supply step S142 is progressed, the controller 200 may activate the circulating pump 194 of the circulating part 190 in a wash water circulating direction after elapse of a predetermined time at step S144. As the circulating pump 194 is activated, the wash water collected in the sump 127 of the tub 120 and the drain chamber 184 corrected to the sump 127 may be supplied to the diffusion nozzle 126*a* of the vibration insulating part 126 through the circulating hose 194*a* by the circulating pump 194. And, the wash water supplied to the diffusion nozzle 126*a* may be diffusively sprayed to the laundry loaded in the drum 150 from the diffusion nozzle 126*a*, thereby progressing the laundry soaking [S146].

Meanwhile, as the laundry soaking step S146 is progressed, if a predetermined time expires, the controller 200 may activate the heater 128 so as to heat and circulate the wash water collected in the sump 127 of the tub 120 at step S148. Here, the predetermined time may include a time sufficient for the heater 128, which is provided to the sump 127, to be completely submerged in the wash water collected in the sump 127 and can be varied depending on conditions such as the tub 120, the sump 127, the drain chamber 184, a water supply pressure, etc.

Thereafter, the wash course can be ended by progressing the washing cycle S150, the rinsing cycle S160 and the dewatering cycle S170 in general.

Alternatively, if a laundry amount detected by the aforementioned laundry amount detection is smaller than a set laundry amount, a detergent amount, a wash water amount, a rinsing count, a wash time and the like, which correspond to the laundry amount calculated in the laundry amount detection S110, may be determined. And, the determined amounts of the wash water and the detergent are supplied at step S132.

Here, as the wash water supply S142 is progressed, the controller 200 may determine whether a water level of wash water supplied to the tub meets a set water level through the water level sensor 188 after expiration of a predetermined time at step S134.

Here, the set water level may include a water level enough for the heater 128, which may be provided to the sump 127, to be completely submerged in the wash water collected in the sump 127 and can be varied depending on conditions such as the tub 120, the sump 127, the drain chamber 184, a water supply pressure, etc.

Meanwhile, if the water level of the wash water supplied to the tub 120 fails to meet the set water level, the circulating pump 194 of the circulating part 190 may be operated in a direction reverse to a wash water progressing direction at step S136.

Here, as the circulating pump 194 is operated in the reverse direction, the wash water collected in the sump 127 of the tub 120 and the drain chamber 184 connected to the sump 127 may not be moved but may remain in the sump 127 of the tub 120. In doing so, as the wash water remaining in the circulating hose 194*a* flows into the drain chamber 184 and the sump 127 in response to the reverse operation of the circulating pump 194, the heater 128 provided to the sump 127 can be completely submerged in a shorter time owing to the wash water.

Meanwhile, in step S134 of determining whether the water level of the wash water meets the set water level, if the water level of the wash water is detected as being equal to or greater than the set water level, the controller 200 may activate the heater 128 to heat the wash water collected in the sump 127 of the tub 120.

Thereafter, the wash course can be ended by progressing the washing cycle S150, the rinsing cycle S160 and the dewatering cycle S170 in general.

In a method of controlling a laundry treating device according to an embodiment of the present disclosure, a washing cycle time can be reduced by improving a timing of heating wash water while supplying the wash water.

And, in a method of controlling a laundry treating device according to an embodiment of the present disclosure, a washing cycle time can be reduced by skipping a laundry soaking step depending on an amount of laundry.

It will be apparent to those skilled in the art that various modifications and variations can be made in the present disclosure without departing from the spirit or scope of the disclosure. Thus, it is intended that the present disclosure covers the modifications and variations of this disclosure provided they come within the scope of the appended claims and their equivalents.

What is claimed is:

1. A method of controlling a laundry treating device comprising a tub configured to store wash water therein, a drum rotatably disposed within the tub to receive laundry therein, a heater configured to heat the wash water, a circulating pump configured to circulate the wash water supplied to the tub, and a controller configured to control the tub, the drum, the heater, and the circulating pump, the method comprising:

detecting an amount of laundry received in the drum;

supplying the wash water to the tub based on the amount of laundry;

soaking the laundry by operating the circulating pump; and heating the wash water by operating the heater, wherein the soaking comprises:

operating the circulating pump in a forward direction to circulate the wash water during the supplying of the wash water to the tub, when the amount of laundry detected in the detecting step is greater than a predetermined laundry amount, and operating the circulating pump in a reverse direction such that the wash water flows backward and supplies a predetermined water level for operation of the heater during the supplying of the wash water to the tub, when the amount of laundry detected in the detecting step is equal to or less than the predetermined laundry amount, and wherein the controller is configured to:

detect the amount of laundry received in the drum;

compare the detected amount of the laundry to the predetermined laundry amount;

operate the circulating pump in the forward direction in response to the detected amount of the laundry being greater than the predetermined laundry amount; and operate the circulating pump in the reverse direction in response to the detected amount of the laundry being equal to or less than the predetermined laundry amount.

2. The method of claim 1, wherein the heating the wash water is executed after standing by for a predetermined time after the supplying the wash water to the tub.

3. The method of claim 2, wherein the predetermined time is a time taken for the wash water stored in the tub to reach a predetermined water level for the heater to be submerged.

4. The method of claim 1, further comprising waiting for a predetermined time after completion of the soaking the laundry.

5. The method of claim 4, wherein waiting for the predetermined time comprises waiting until a water level of the wash water reaches a predetermined water level for the heater to be submerged.

* * * * *